US010654106B2

(12) United States Patent
Eonta et al.

(10) Patent No.: US 10,654,106 B2
(45) Date of Patent: May 19, 2020

(54) PROCESS FOR PRODUCING METALS AND METAL ALLOYS USING MIXING COLD HEARTH

(71) Applicant: MolyWorks Materials Corporation, Los Gatos, CA (US)

(72) Inventors: Christopher Paul Eonta, Los Gatos, CA (US); Andrew Van Os LaTour, Hayward, CA (US); Scott Weston Steiner, Ukiah, CA (US)

(73) Assignee: MolyWorks Materials Corp., Los Gatos, CA (US)

( * ) Notice: Subject to any disclaimer, the term of this patent is extended or adjusted under 35 U.S.C. 154(b) by 323 days.

(21) Appl. No.: 15/898,474

(22) Filed: Feb. 17, 2018

(65) Prior Publication Data

US 2018/0169761 A1 Jun. 21, 2018

Related U.S. Application Data

(62) Division of application No. 14/831,911, filed on Aug. 21, 2015, now Pat. No. 9,925,591.

(Continued)

(51) Int. Cl.
*C22B 9/22* (2006.01)
*F27B 14/02* (2006.01)

(Continued)

(52) U.S. Cl.
CPC ..... *B22F 9/06* (2013.01); *B22D 11/0605* (2013.01); *B22D 11/144* (2013.01); *B22D 45/00* (2013.01);

(Continued)

(58) Field of Classification Search
None
See application file for complete search history.

(56) References Cited

U.S. PATENT DOCUMENTS 2,699,576 A 1/1955 Colbry et al.
3,917,479 A * 11/1975 Sayce ..... C03B 5/025 75/10.19

(Continued)

FOREIGN PATENT DOCUMENTS

EP 0448773 A2 * 10/1991

OTHER PUBLICATIONS

William R. Chinnis, "Plasma Cold Hearth Melting of Titanium in a Production Furnace", Teledyne Allvac, 2020 Ashcraft Avenue, Monroe, NC 28110, pp. 1-7, date unknown.

*Primary Examiner* — George Wyszomierski
(74) *Attorney, Agent, or Firm* — Stephen A. Gratton

(57) ABSTRACT

A metallurgical system for producing metals and metal alloys includes a fluid cooled mixing cold hearth having a melting cavity configured to hold a raw material for melting into a molten metal, and a mechanical drive configured to mount and move the mixing cold hearth for mixing the raw material. The system also includes a heat source configured to heat the raw material in the melting cavity, and a heat removal system configured to provide adjustable insulation for the molten metal. The mixing cold hearth can be configured as a removal element of an assembly of interchangeable mixing cold hearths, with each mixing cold hearth of the assembly configured for melting a specific category of raw materials. A process includes the steps of providing the mixing cold hearth, feeding the raw material into the melting cavity, heating the raw material, and moving the mixing cold hearth during the heating step.

12 Claims, 5 Drawing Sheets

Related U.S. Application Data

(60) Provisional application No. 62/039,970, filed on Aug. 21, 2014, provisional application No. 62/039,987, filed on Aug. 21, 2014, provisional application No. 62/039,996, filed on Aug. 21, 2014, provisional application No. 62/040,001, filed on Aug. 21, 2014, provisional application No. 62/040,006, filed on Aug. 21, 2014.

(51) Int. Cl.

| | |
|---|---|
| ***B22F 9/06*** | (2006.01) |
| ***F27D 11/06*** | (2006.01) |
| ***F27D 11/08*** | (2006.01) |
| ***F27D 11/00*** | (2006.01) |
| ***F27D 27/00*** | (2010.01) |
| ***F27D 9/00*** | (2006.01) |
| ***F27D 3/14*** | (2006.01) |
| ***F27D 3/00*** | (2006.01) |
| ***F27D 1/00*** | (2006.01) |
| ***B22D 45/00*** | (2006.01) |
| ***B22F 9/08*** | (2006.01) |
| ***B22D 11/06*** | (2006.01) |
| ***B22D 11/14*** | (2006.01) |
| ***F27B 14/04*** | (2006.01) |
| ***F27B 14/08*** | (2006.01) |
| ***F27B 14/14*** | (2006.01) |

(52) U.S. Cl.

CPC ..... *B22F 9/082* (2013.01); *C22B 9/226* (2013.01); *F27B 14/02* (2013.01); *F27B 14/04* (2013.01); *F27B 14/08* (2013.01); *F27B 14/14* (2013.01); *F27D 1/0006* (2013.01); *F27D 3/0024* (2013.01); *F27D 3/14* (2013.01); *F27D 9/00* (2013.01); *F27D 11/00* (2013.01); *F27D 11/06* (2013.01); *F27D 11/08* (2013.01); *F27D 27/00* (2013.01); *B22F 2009/084* (2013.01); *B22F 2009/0836* (2013.01); *B22F 2999/00* (2013.01); *F27D 2009/001* (2013.01)

(56) References Cited

U.S. PATENT DOCUMENTS

| | | | | |
|---|---|---|---|---|
| 4,066,117 | A | 1/1978 | Clark et al. | |
| 5,028,248 | A * | 7/1991 | Williams | C03B 5/025 373/20 |
| 5,122,181 | A * | 6/1992 | Dube | C22B 1/005 75/10.21 |
| 5,649,992 | A | 7/1997 | Carter, Jr. | |
| 5,816,311 | A | 10/1998 | Osada et al. | |
| 6,019,812 | A | 2/2000 | Volas et al. | |
| 6,026,113 | A | 2/2000 | Pavlicevic | |
| 6,179,610 | B1 | 1/2001 | Suey et al. | |
| 7,093,646 | B2 | 8/2006 | Nakayama et al. | |
| 7,137,436 | B2 | 11/2006 | Jackson et al. | |
| 8,085,829 | B2 | 12/2011 | Johansson et al. | |
| 2005/0012252 | A1 * | 1/2005 | Yu | C21C 5/5205 266/241 |
| 2005/0145065 | A1 | 7/2005 | Carter, Jr. et al. | |
| 2008/0179034 | A1 | 7/2008 | Forbes | |
| 2012/0193842 | A1 | 8/2012 | Tetsumoto | |
| 2014/0161691 | A1 | 6/2014 | Feraud | |
| 2016/0052060 | A1 | 2/2016 | Eonta | |
| 2016/0123664 | A1 * | 5/2016 | Tomita | F27B 3/085 75/10.34 |

* cited by examiner

PROCESS FOR PRODUCING METALS AND METAL ALLOYS USING MIXING COLD HEARTH

CROSS REFERENCE TO RELATED APPLICATIONS

This application is a division of U.S. patent application Ser. No. 14/831,911, filed on Aug. 21, 2015, U.S. Pat. No. 9,925,591, which claims priority from U.S. Provisional No. 62/039,970, filed Aug. 21, 2014, U.S. Provisional No. 62/039,987, filed Aug. 21, 2014, U.S. Provisional No. 62/039,996, filed Aug. 21, 2014, U.S. Provisional No. 62/040,001, filed Aug. 21, 2014 and U.S. Provisional No. 62/040,006, filed Aug. 21, 2014, all of which are incorporated herein by reference.

BACKGROUND

Specialty metals and metal alloys, such as titanium, titanium alloys and nickel based super alloys, can be produced by a process known as cold hearth melting. In cold hearth melting, a heat source, such as a plasma torch or an electron beam is used to heat raw materials into a molten material. U.S. Pat. Nos. 6,019,812 and 7,137,436 disclose exemplary prior art cold hearth systems. In these systems, the hearth is made of a thermally conductive material, such as copper, and can include a fluid cooling system for maintaining the hearth in solid form. Typically the hearth is held stationary during the melting process, and can be configured as a chute for transferring the molten material for further processing. Usually there is no mixing in the hearth other than gravity induced currents resulting from density differences in the molten material. Also, the heat source is a stationary element, which does not provide even heating of the molten material in the hearth.

Due to the high cost of producing these specialty metals and metal alloys, purity and quality are of critical importance. It is thus desirable to eliminate any contaminants from the ingots produced during the cold hearth melting process. For example, in the case of titanium, hard alpha inclusions, such as oxygen, nitrogen, and carbon, sometimes form in titanium ingots. These inclusions, which are often introduced during the cold hearth melting process, provide points of weakness and potential failure in articles formed from the ingot, such as turbine blades and medical prosthesis. The elimination of these contaminants provides a significant challenge to manufacturers of specialty metals and metal alloys.

Another challenge for manufacturers of specialty metals is the optimization of process conditions to accommodate particular raw materials and products. In general, cold hearth melting requires expensive systems and large energy expenditures. However, prior art systems may not be suitable for processing different types of raw materials and different products. Similarly, energy can be wasted if the systems and processes are not well suited to the raw materials and products. It would thus be advantageous for a cold hearth system and process to be able to accommodate different raw materials and different process parameters with minimal energy expenditures. In addition, it would be advantageous for a system and process to be able to accommodate different types of products. For example, in addition to metal ingots, specialty metals and metal alloys can be produced as metal powders. However, most prior art cold hearth systems and processes do not interface efficiently with conventional atomization systems and processes. Similarly, most prior art cold hearth melting systems do not interface efficiently with conventional roll casting systems and processes.

In view of the deficiencies in conventional cold hearth systems and processes, the present disclosure is directed to an improved cold hearth metallurgical system and an improved process for producing metals and metal alloys. However, the foregoing examples of the related art and limitations related therewith are intended to be illustrative and not exclusive. Other limitations of the related art will become apparent to those of skill in the art upon a reading of the specification and a study of the drawings.

SUMMARY

A metallurgical system for producing metals and metal alloys includes a mixing cold hearth having fluid cooled walls and a melting cavity configured to hold a raw material for melting into a molten metal, and an induction coil configured to generate an electromagnetic field for stirring and heating the raw material into the molten metal. The mixing cold hearth also includes a mechanical drive configured to mount and move the mixing cold hearth for mixing the raw material in the melting cavity and to rotate the mixing cold hearth for pouring molten metal from the melting cavity. Movement of the mixing cold hearth by the mechanical drive can include both oscillatory motion and rotational motion or a combination thereof. The mixing cold hearth can also include a skull at least partially lining the melting cavity and configured to provide a heat transfer boundary for the molten metal. In addition, the mixing cold hearth can comprise a removal element of an assembly of interchangeable mixing cold hearths, with each mixing cold hearth of the assembly configured for melting a specific category of raw material to produce a specific product.

The metallurgical system also includes a heat source configured to heat the raw material in the melting cavity into the molten metal. The heat source can comprise a plasma system, a plasma transferred arc system, an electric arc system, a radio frequency system, an induction system, a photon system, an electron beam energy system, an electric arc energy system or a combination of one or more of these systems. During a cold hearth melting process using the metallurgical system, heat can be transferred from the heat source to the raw material, to the skull, to the mixing cold hearth and finally to the cooling fluid. In addition, the mixing cold hearth can be moved during the melting process to mix the raw material and to also move the skull with respect to the molten metal. The skull can also contain high melting temperature components of the metal or metal alloy being produced, such that movement of the mixing cold hearth also moves the skull out of the molten metal subjecting it to the heat source and melting portions of the skull into the molten metal.

The metallurgical system can also include a heat removal system configured to provide adjustable insulation for the molten metal to conduction, radiation, and convection. The heat removal system includes a support structure, a plurality of tiles mounted to the support structure, and cooling passages in the support structure in flow communication with the cooling fluid source. The tiles are removeable such that particular tiles of an assembly of interchangeable tiles can be selected and installed to provide variable insulation for different raw materials and molten metals. This permits control of the parameters within the melting cavity including temperature and heat transfer, such that the melting process can be tailored to a particular category of raw materials or metals. The metallurgical system can also include a sealed chamber configured to contain the mixing cold hearth, the heat source and the heat removal system. In addition, the sealed chamber can be an element of pressure vessel or a vacuum vessel, such as a furnace, and the heat removal system can be formed on the inner walls of the pressure vessel.

The metallurgical system can also include either an atomization system configured to atomize the molten metal, or alternately a roll caster system configured to cool the molten metal into a solidified shape. The atomization system includes an electrically conductive atomization die having an orifice configured to receive the molten metal from the mixing cold hearth, and an induction coil configured to generate a magnetic field for interacting with the molten metal to generate a metal powder having particles with a desired shape and particle size. The atomization system also includes an atomization tower configured to receive and cool the metal particles for segregation into groups of similar particles size using gravity, screening or cyclonic separation. In addition, the atomization die can comprise a removal element of an assembly of interchangeable atomization dies, with each atomization die of the assembly configured for atomizing a specific category of raw materials to produce a specific product.

The roll caster system includes a fluid cooled mold configured to receive the molten metal from the mixing cold hearth, a fluid cooled roll caster assembly configured to cool the molten metal into a solidified shape, and a moveable dovetail configured to adjust a size of the solidified shape. In addition, the roll caster assembly can comprise a removal element of an assembly of interchangeable roll caster assemblies, with each roll caster assembly of the assembly configured for cooling a specific category of raw materials to produce a specific product.

A process for producing metals and metal alloys includes the step of providing a mixing cold hearth having a melting cavity configured to hold a raw material for melting into a molten metal, an induction coil configured to generate an electromagnetic field for stirring and heating the raw material into the molten metal, and a mechanical drive configured to move the mixing cold hearth for mixing the raw material in the melting cavity. The process also includes the steps of: feeding the raw material into the melting cavity; heating the raw material in the melting cavity to form a molten metal; stirring the raw material during the heating step; and moving the mixing cold hearth during the heating step using the mechanical drive. The moving step can be performed using both oscillatory movement and rotational movement of the mixing cold hearth or a combination thereof. The process can also include the steps of providing a skull in the melting cavity containing selected alloys, and rotating the mixing cold hearth during the heating step to at least partially melt the skull and incorporate the alloys into the molten metal.

The process can also include the steps of: providing a heat removal system having a plurality of fluid cooled tiles configured to provide adjustable insulation for the molten metal; and controlling parameters within the melting cavity using the heat removal system.

The process can also include the steps of: providing an electrically conductive atomization die having an orifice for receiving the molten metal from the mixing cold hearth, and an induction coil configured to generate a magnetic field for interacting with the molten metal to generate a metal powder having a desired shape and particle size, and an atomization tower configured to receive and cool the metal powder; transferring the molten metal from the mixing cold hearth to the atomization die; and atomizing the molten metal using the atomization die while generating the magnetic field.

The process can also include the steps of: providing a fluid cooled mold configured to receive the molten metal from the mixing cold hearth, a fluid cooled roll caster assembly configured to cool the molten metal into a solidified shape, and a moveable dovetail configured to adjust a size of the solidified shape; transferring the molten metal from the mixing cold hearth to the mold; cooling the molten metal in the mold using the roll caster assembly; and adjusting the size of the solidified shape using the dovetail.

The process can also include the steps of providing the mixing cold hearth as a removal element of an assembly of interchangeable mixing cold hearths, with each mixing cold hearth of the assembly configured for melting a specific category of raw materials; and selecting a particular mixing cold hearth to melt a specific category of raw materials to produce a specific product.

BRIEF DESCRIPTION OF THE DRAWINGS

Exemplary embodiments are illustrated in the referenced figures of the drawings. It is intended that the embodiments and the figures disclosed herein be considered illustrative rather than limiting.

DETAILED DESCRIPTION

Figure 1:
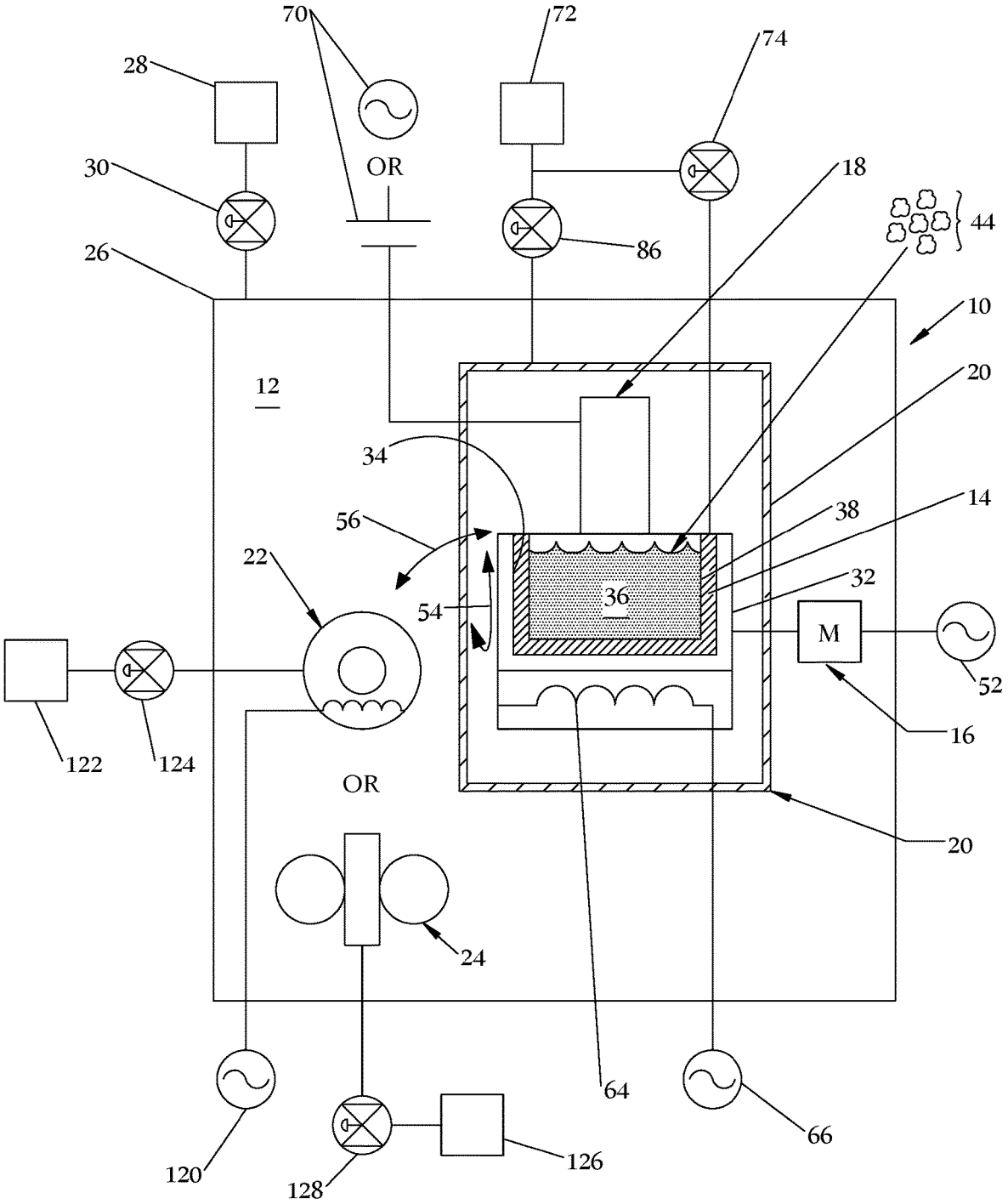
FIG. 1 is a schematic view of a metallurgical system for producing metals and metal alloys.

Referring to FIG. 1, a metallurgical system 10 for producing metals and metal alloys is illustrated. The metallurgical system 10 includes a sealed chamber 12, a mixing cold hearth 14 having a mechanical drive 16, a heat source 18, and a heat removal system 20. The metallurgical system 10 can also include either an atomization system 22, or alternately a roll caster system 24.

Sealed Chamber.

Still referring to FIG. 1, the sealed chamber 12 can be contained in a vessel 26 such as a multi-walled sealed furnace configured to provide cold hearth melting of metals and metal alloys. The vessel 26 can comprise a pressure vessel or a vacuum vessel and can have a desired shape, such as cylindrical or rectangular. In addition, the vessel can be made of a suitable material, such as a refractory material, a high temperature metal, or combinations of these materials. The sealed chamber 12 can be in flow communication with an inert gas supply 28 having a flow control valve 30 such that an inert gas atmosphere can be provided within the sealed chamber 12. Exemplary inert gases include argon and helium or a mixture thereof. In addition, the sealed chamber 12 can have a selected positive pressure or can be in flow communication with a vacuum pump to provide a selected vacuum pressure.

Mixing Cold Hearth.

Still referring to FIG. 1, the mixing cold hearth 14 is contained within the sealed chamber 12 and includes walls 32 configured to form a melting cavity 34 for mixing and melting a raw material 44 to form a molten metal 36. In the illustrative embodiment, the mixing cold hearth 14 has a generally cylindrical shape, which provides a generally circular melting cavity 34. This shape provides the most efficient heat transfer surfaces for the walls 32 of the melting cavity 32. However, other suitable shapes for the mixing cold hearth 14 include square, rectangular, triangular or polygonal. In addition, the mixing cold hearth 14 includes a skull 38 at least partially lining the melting cavity 34 configured to provide a heat transfer boundary for the molten metal 36 and a source of selected alloys incorporation into the molten metal 36. The mixing cold hearth 14 comprises a fluid cooled vessel having tubular passages (not shown) within the walls 32 that have an inlet 40 (FIG. 2B) and an outlet 42 (FIG. 2B) in fluid communication with a cooling fluid system 72 (FIG. 1) having one or more flow control valves 74 (FIG. 1). A cooling fluid 46 (FIG. 2B), such as water, ethylene glycol, NaK, or another fluid, generated and cooled by the cooling fluid system 72 (FIG. 1) flows through the tubular passages within the mixing cold hearth 14, keeping it from melting. A raw material 44 can be fed into the mixing cold hearth 14 continuously, semi-continuously, or in batches. The raw material 44 that is in direct contact with the mixing cold hearth 14 and not exposed to the heat source 18 is conventionally unmelted. The skull 38 is located between the melting cavity 34 and the molten metal 36. The skull 38 is in a state of dynamic equilibrium, with the inner boundary constantly melting and solidifying as heat is transferred out of the molten metal 36. Heat is transferred from the heat source 18 to the raw material 44, to the skull 38, to the walls 32 of the mixing cold hearth 14. and finally into the cooling fluid 46 (FIG. 2B). In addition, the mixing cold hearth 14 is configured to move the skull 38 within the mixing cold hearth 14 such that it can be exposed to the heat source 18 and at least partially melted into the molten metal 36. Rotational movement of the mixing cold hearth 14 by the mechanical drive is particularly effective in moving the skull 38 into and out of the molten metal 36.

Figure 2A:
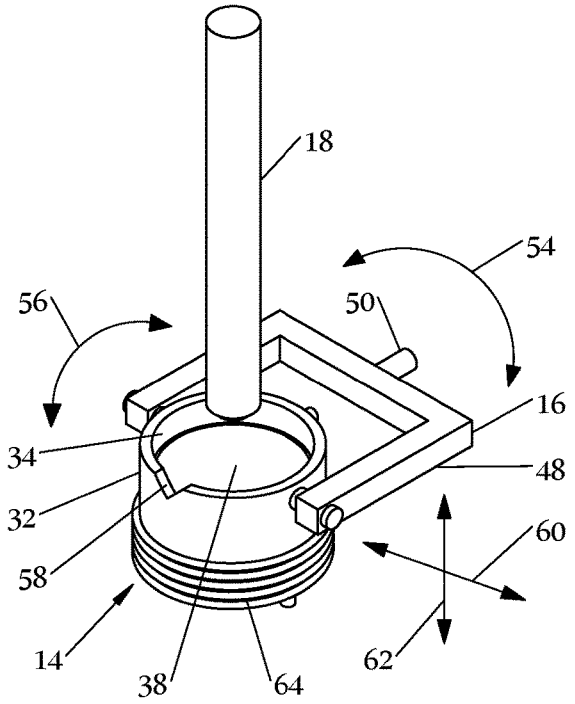
FIG. 2A is a perspective view of a mixing cold hearth and heat source of the metallurgical system.
Figure 2B:
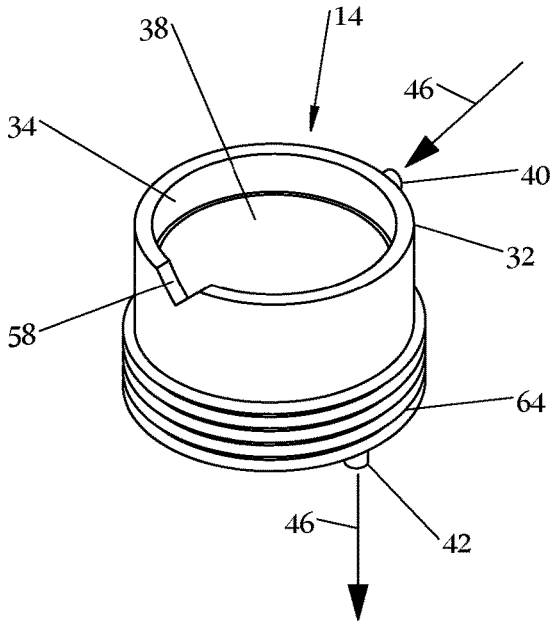
FIG. 2B is a perspective view of the mixing cold hearth of the metallurgical system.

Referring to FIGS. 2A-2B, the mixing cold hearth 14 is mounted within the sealed chamber 12 by the mechanical drive 16. In addition, as will be further explained, the mechanical drive 16 moves the mixing cold hearth 14 in an oscillatory motion and also a rotational motion during melting of the raw materials 44 (FIG. 1), and in a separate pouring motion for discharging the molten metal 36 (FIG. 1) from the melting cavity 34. As shown in FIG. 2A, the mechanical drive 16 includes a mechanical linkage 48 and a hydraulic actuator 50 coupled to a hydraulic source 52 (FIG. 1). The mechanical linkage 48 (FIG. 2A) movably mounts the mixing cold hearth 14 for rotation in an oscillatory manner in both directions along an oscillatory axis 60 (FIG. 2A) for mixing the molten metal 36, as indicated oscillatory arrow heads 54 (FIG. 2A). In addition, the mechanical linkage 48 (FIG. 2A) movably mounts the mixing cold hearth 14 for rotation in both directions along a pouring axis 62 (FIG. 2A) for moving the skull 38 during the melting process and for pouring the molten metal 36, as indicated by pouring arrow heads 56 (FIG. 2A). In the illustrative embodiment, the oscillatory axis 60 is generally perpendicular to the pouring axis 62, and allows oscillatory rotation of from −45 degrees to 45 degrees. Additionally, the mixing cold hearth 14 can rotate along the pouring axis 62 from 0 to 135 degrees, with 0 degrees representing the position of the mixing cold hearth 14 during melting, and 90 degrees representing the position of the mixing cold hearth 14 during pouring. The oscillatory movement of the mixing cold hearth 14 by the mechanical drive 16 exposes unmelted raw material to the heat source 18. This oscillatory movement can also be used to move the skull 38 and expose it to the heat source 18 for melting. Additionally, the mixing cold heath 14 can be rotated by the mechanical drive 16 during the melting process to further mix the raw material 44 and expose the skull 38 to the heat source 18. In addition, gas flow from the heat source 18 pushes the molten metal 36 (FIG. 1), creating additional stirring. As shown in FIGS. 2A and 2B, the mixing cold hearth 14 has a v-shaped section 58 that allows the molten metal 36 to pour out of the melting cavity 34 easily when it is rotated to the pouring position.

Still referring to FIGS. 2A-2B, the mixing cold hearth 14 can also include an induction coil 64 connected to a power source 66 (FIG. 1). The induction coil 64 can be mounted below the melting cavity 34 surrounding an outside perimeter of the mixing cold hearth 14 substantially as shown. The induction coil 64 is configured to induce electromagnetic stirring using a magnetic field generated by the power source 66 (FIG. 1), or alternately by directing current from the heat source 18. In addition, the magnetic field can be produced by either DC or AC power.

The mixing cold hearth 14 can be made from an electrically conductive material, such as copper, molybdenum, titanium, nickel, and alloys thereof, with copper and alloys thereof being a preferred material. Although copper melts at a temperature significantly below that of the raw material being melted to produce specialty metals, it is able to stay relatively cool due to its very high thermal conductivity. In addition, copper is able to transfer heat to the cooling fluid 46 faster than the molten metal 36 can transfer heat into the mixing cold hearth 14. The mixing cold hearth 14 utilizes this principle of heat transfer to increase thermal efficiency and thus exhibits an improvement over existing cold hearth melting technology.

Figure 2C:
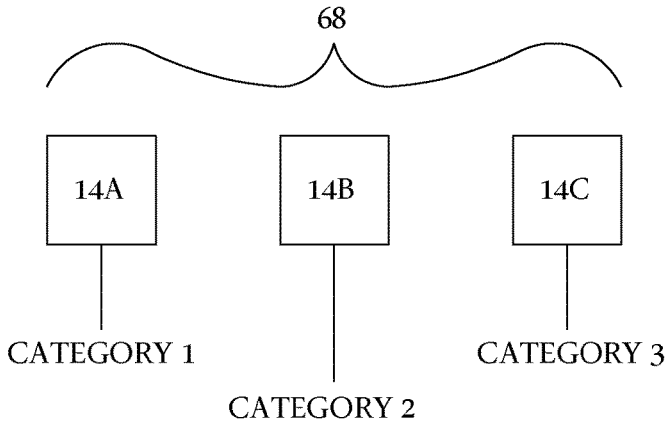
FIG. 2C is a schematic view of an assembly of interchangeable mixing cold hearths with each cold hearth of the assembly configured for melting a specific category of raw materials.

As shown in FIG. 2C, the mixing cold hearth 14 is removable from the sealed chamber 12, and can comprise an element of an assembly 68 of interchangeable mixing cold hearth 14A, 14B, 14C. Each mixing cold hearth 14A, 14B, 14C can be constructed of a material tailored to melt a particular category of raw materials (category 1, category 2, category 3) to produce a particular metal or metal alloy. By way of example, category 1 can comprise raw materials for producing a first metal or metal alloy, category 2 can comprise raw materials for producing a second metal or metal alloy, and category 3 can comprise raw materials in the form of a metal ore having particular characteristics. The assembly 68 of mixing cold hearths 14A, 14B, and 14C allows the thermal efficiency of the melting process to be maximized. For example, particular mixing cold hearths 14A, 14B, 14C of the assembly 68 can be constructed with materials that have a lower thermal conductivity than copper, but which still transfer heat significantly better than the raw material 44 intended to be melted. The raw material 44 would also have a higher melting point than copper. By proper selection of materials for the mixing cold hearth 14, thermal efficiency is optimized by allowing the mixing cold hearth 14 to retain as much heat as possible without melting it. The energy required to heat the vessel 26 (FIG. 1) is also reduced, as well as the energy required to chill the cooling fluid 46 (FIG. 2B).

A significant advantage of the mixing cold hearth 14 is that inclusions can be removed from molten metal 36 (FIG. 1) in a single melt. A high density inclusion (HDI) has both a higher melting point and a higher density than the raw material 44 (FIG. 1) being purified or alloyed to produce a particular metal or metal alloy. During operation of the mixing cold hearth 14, HDIs will remain unmelted, sinking to the bottom of the mixing cold hearth 14, and becoming trapped in the skull 38. Low density inclusions (LDI) are dissolved due to the intensity of the heat source 18, and exposure to molten metal 36. Due to the fact that HDIs and LDIs are removed by density separation and dissolution respectively, removal of both HDIs and LDIs can be increased by increasing residence time. In traditional hearth melting technologies, residence time is limited. In the mixing cold hearth 14, however, residence time is adjustable. Prior art hearth melting systems depend on a combination of heat sources and hearths to accomplish the appropriate residence time. A four heat source system is a common configuration for the industry, where the first heat source is above a retort cold hearth, the second two heat sources are above two refining cold hearths, and finally a heat source is positioned above a mold. In this configuration, melting technologies are limited to a 1-4 minute residence time; they have only four minutes to remove all HDIs and LDIs. In contrast, the mixing cold hearth 14 described herein can adjust the residence time from 0-200 minutes. This capability for additional residence time increases the ability to produce high quality metals and metal alloys when compared to prior art systems.

Heat Source.

Referring to FIGS. 1 and 2A, the heat source 18 can comprise plasma system, a plasma transferred arc system, an electric arc system, a radio frequency system, an induction system, a photon system, or an electron beam energy system or a combination of one or more of these systems. In the illustrative embodiment, the heat source 18 comprises a plasma transferred arc connected to a power source 70 (FIG. 1) and a separate gas source (not shown). In this case, the heat source generates a plasma arc between the electrode of a plasma torch and the work piece, which can be the mixing cold hearth 14, the atomization system 22 (FIG. 1), or the raw material 44 (FIG. 1) contained in the mixing cold hearth 14. The plasma can be generated using an inert plasma gas such as helium or argon. A reaction between the raw material 44 (FIG. 1) and the plasma gas can also be accomplished by using a reactive plasma gas such as oxygen, nitrogen, hydrogen, or another gas. The plasma torch typically operates using a DC power source 70 (FIG. 1) but could possibly be operated using AC power. An arc is established when the voltage is between 20-500 volts and the amperage is between 1-5000 amps. The transferred plasma arc melts exposed raw material 44 (FIG. 1) in the melting cavity 34 as current travels from the raw material 44 to the mixing cold hearth 14. The heat source 18 can be adjustable in all directions and can be programmed to move in a preset pattern.

Heat Removal System.

Figure 3A:
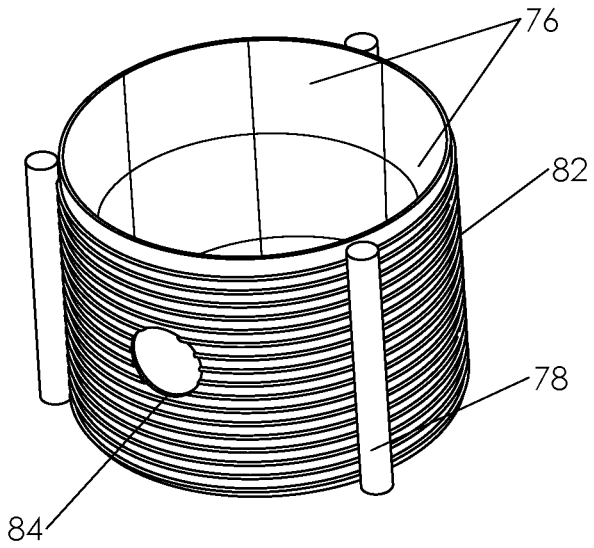
FIG. 3A is a perspective view of a heat removal system of the metallurgical system.
Figure 3B:
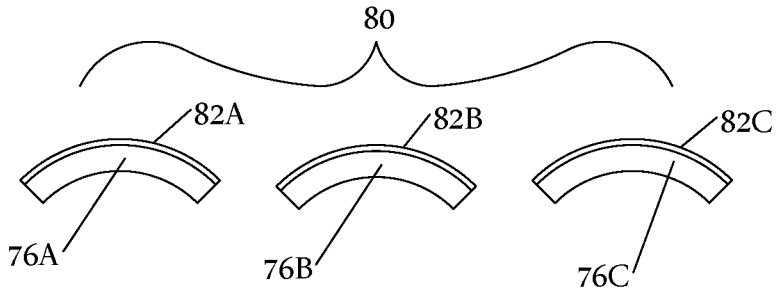
FIG. 3B is a schematic view of an assembly of interchangeable tiles of the heat removal system with each tile of the assembly having a different insulation value.

Referring to FIGS. 3A and 3B, the heat removal system 20 is shown separately. The heat removal system 20 includes a plurality of tiles 76 mounted to a support structure 78 within the sealed chamber 12. The heat removal system 20 is preferably separate from the vessel 26 but can be installed on the interior walls thereof. In the illustrative embodiment, the support structure 78 is generally cylindrical and the tiles have an arcuate shape. The tiles 76 act as variable insulators to conduction, radiation, and convection, and can be formed of a material such as titanium, molybdenum, nickel, copper, or their alloys. In addition, the tiles 76 can be positioned in such a way that heat radiation is reflected back towards the molten metal 36 (FIG. 1) in the melting cavity 34 (FIG. 1). Suitable geometries for the tiles 76 can include spherical, conical, trapezoidal, square, rectangle, or any other desired shape. In addition, the tiles 76 can be arranged such that they can optimally insulate the metal 36 (FIG. 1) in the melting cavity 34 (FIG. 1) to radiation, conduction, and convection. The tiles 76 are removable and their configuration is adjustable.

As shown in FIG. 3B, multiple tiles 76A, 76B, 76C can be elements of an assembly of tiles 80 having different material compositions. The tiles can also include interchangeable insulation elements 82 to provide variable insulation values R1, R2, R3, such that the heat removal capabilities can be optimized for any specific melt by changing the insulation elements 82A, 82B, 82C. Alternately, the insulation elements 82 can be separate from the tiles 76. Additionally, the tiles 76 are removable which gives the advantage of insulation that is easily repaired or replaced. Further, the interchangeable nature of the tiles 76 enables selective usage of non-reactive tiles in a melt in which reactive metals are present. The heat removal system 20 also includes passageways (not shown) in flow communication with an inlet 84 (FIG. 3A) and an outlet (not shown). In addition, the inlet 84 and the outlet (not shown) can be in flow communication with the cooling fluid system 72 (FIG. 1) via a separate flow control valve 86 (FIG. 1). This arrangement allows cooling fluid 46 (FIG. 2B) to flow through the heat removal system 20 and transfer heat out of the sealed chamber 12 at a rate that prevents the components of the heat removal system 20 from melting. The tiles 76 are intended to be kept hot, but may be cooled with fluid as needed to prevent melting. The cooling fluid 46 can comprise water, ethylene glycol, NaK, or another fluid. The support structure 78 can also be fluid-cooled, removable and adjustable. The structural material for the support structure 78 can comprise steel, titanium, copper, and alloys thereof. The heat removal system 20, when installed within the sealed chamber 12, increases thermal efficiency by decreasing the heat lost through the walls of the vessel 26.

The tiles 76 (FIG. 3A) can comprise materials that are non-reactive with reactive raw materials and metals and thus eliminate a potential source of contamination. Additionally, the heat removal system 20 decreases required maintenance by allowing replacement of a single tile 76 in the event of damage. In a conventional prior art system, if some molten metal were to damage part of a vessel wall, a lengthy shutdown would be needed to repair the damage. However, with the heat removal system 20, only the damaged tiles 76 would need to be replaced, and they can be removed and replaced significantly faster than a vessel wall could be replaced. The insulation added to the interior of the vessel 26 also decreases wear on the view ports and furnace walls that is caused by thermal degradation. Further, the heat removal system 20 decreases energy consumption and power costs by reducing the energy needed to heat the vessel 26, and reducing the energy needed to cool the cooling fluid 46. By increasing thermal efficiency, reducing potential contamination, and reducing maintenance, the heat removal system 20 provides a significant improvement to metallurgical furnace insulation.

Figure 4B:
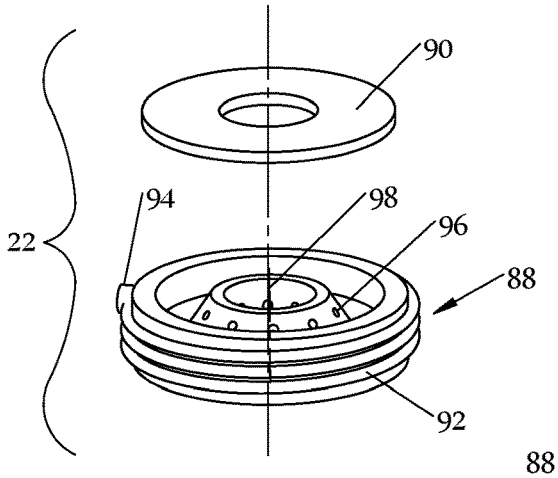
FIG. 4B is a perspective view of the atomization system of the metallurgical system.
Figure 4A:
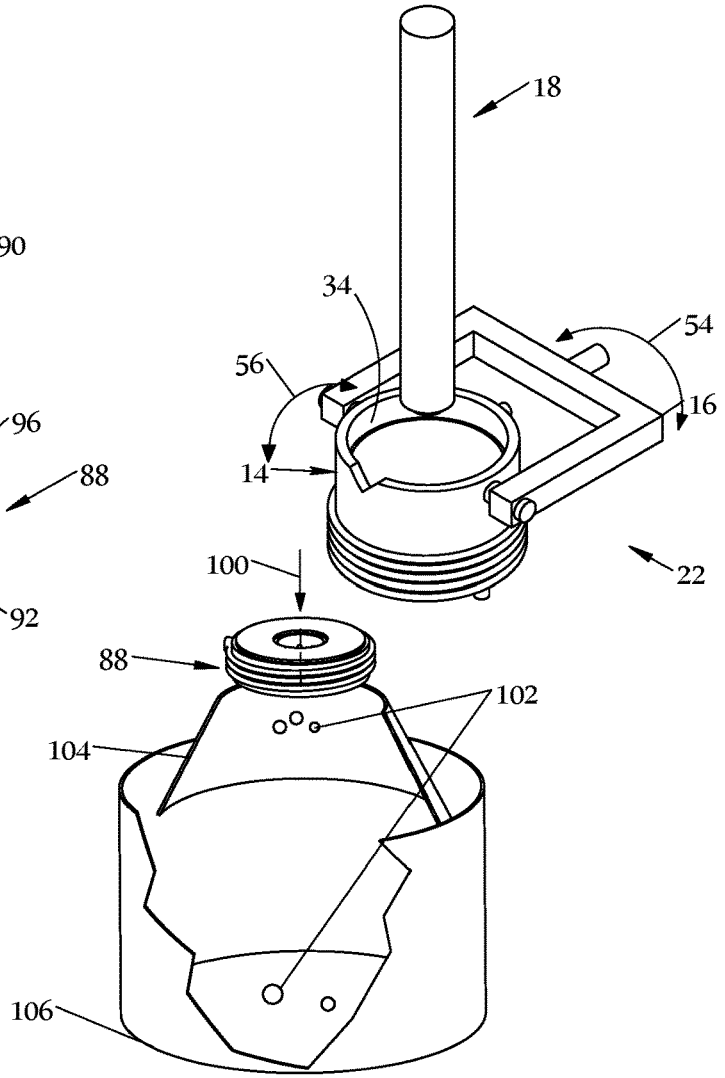
FIG. 4A is a perspective view of the mixing cold hearth and an atomization system of the metallurgical system.

Referring to FIGS. 4A and 4B, the atomization system 22 is shown. The atomization system 22 includes a fluid cooled atomization die 88, a cover 90 for the atomization die 88 and an induction coil 92 surrounding the atomization die 88. The atomization die 88 comprises an electrically conductive material such as copper, nickel, titanium, molybdenum, tantalum, and alloys thereof. The atomization die 88 includes an orifice 98 for receiving the molten metal 36 from the mixing cold hearth 14. As shown in FIG. 4A, the atomization die 88 can be positioned to receive the molten metal 36 when the mixing cold hearth 14 is rotated to the pour position. In addition, the atomization die 88 can be attached to the mixing cold hearth 14. The orifice 98 of the atomization die 88, which can be generally O-shaped as shown or U-shaped. Gravity or pressure generated by the heat source 18 causes the molten metal 36 to pass through the orifice 98 as a molten stream 100 (FIG. 4A). As shown in FIG. 1, the atomization system 22 can include a separate fluid cooling system 122 and flow control valve 124 for cooling the atomization die 88.

As shown in FIG. 4B, the orifice 98 contains circularly arranged, linearly opposed, impinging gas nozzles 96. The gas nozzles 96 are in flow communication with the inert gas supply 28 (FIG. 1) or a separate inert gas supply (not shown), and are configured to supply high pressure inert gas to the gas nozzles 96 forming turbulent jets and causing disintegration of the molten stream 100 (FIG. 4A) into particles (FIG. 4A) to form a metal powder. The heat source 18 adds superheat to the molten stream 100 (FIG. 4A) as it is directed through the orifice 98. The amount of superheat added to the molten stream 100 (FIG. 4A) can be changed over time or can be kept constant. The amount of superheat added to the molten stream 100 (FIG. 4A) affects the properties of the particles 102 (FIG. 4A) by modifying the rate at which the particles 102 solidify due to increasing the heat flux out of the particles 102 during cooling. Further, with increased superheat, the viscosity of the molten stream 100 (FIG. 4A) is reduced, which changes the way the molten stream 100 disintegrates when impinged upon by the turbulent jets from the gas nozzles 96. Control over the amount of superheat added thus affects the final size and shape of the particles 102 being produced. Additionally, with excess heat in the molten stream 100, the solidification time of the particles 102 is increased, the rate of cooling is increased, and the microstructure of the metal powder is affected. The atomization die 88 enables optimization of superheat to produce the metal powder formed by the particles 102 with more homogeneous fine grained microstructures, improved toughness, and reduced occurrence of segregation and coarse dendrites than prior art systems.

The orifice 98 (FIG. 4B) of the atomization die 88 is electrically conductive and is surrounded by the induction coil 92. If the heat source 18 is in the form of a plasma torch, the induction coil 92 can be activated to produce a magnetic field configured to manipulate the shape and flow of the molten stream 100 (FIG. 4A) passing through the atomization die 88. Alternately a separate power source 120 (FIG. 1) can be used to activate the induction coil 92. The power source 120 (FIG. 1) can be either AC or DC. In addition, the heat source 18 can direct heat through the orifice 98 at the point where the molten stream 100 is interacting with the magnetic field. Simultaneously, the turbulent jets produced by the gas nozzles 96, which are arranged in a circular pattern, impinge on the molten stream 100. The induction coil 92 (FIG. 4B) can be configured in series with the current from the heat source 18, or can be powered independently by an AC power supply.

Inert gas can be pressurized and forced through the gas nozzles 96 in the atomization die 88 at a flow rate of about 0.5 to 30 kg per minute and a pressure of about 5 to 20 megapascals. The molten stream 100 will pass through the orifice 98 at a flow rate in the range of 0.05 to 10 kg per minute. The flow rate of the molten stream 100 can be modified to adjust the particle size of the particles 102. The smaller the diameter or width of the molten stream 100, the finer the particle size of the particles 102. The greater the diameter or width of the molten stream 100, the larger the particle size of the particles 102. The gas nozzles 96 can be arranged such that the inert gas passes through two or more nozzles 96, generating highly turbulent streams, or gas jets. In addition, the gas nozzles 96 can be oriented in such a way that turbulent streams and the molten stream 100 will intersect at the same location. The intersection of the molten stream 100 and the turbulent streams from multiple directions causes the molten stream 100 to be blasted apart into tiny particles 102.

As an additional option, supply passageways within the atomization die 88 for the gas nozzles 96 can contain resonating cavities configured such that they induce the generation of ultrasonic high frequency shock waves within the turbulent streams. The ultrasonic high frequency shock waves can be used to modify the disintegration of the molten stream 100, thus adding significantly increased control over the particle size range of the particles 102 of the final powder. The diameters of the particles 102 can range from 1-500 μm.

As shown in FIG. 4A, the atomization system 22 also includes an atomization tower 104 for cooling the particles 102 and a collection chamber 106 for collecting the particles 102. The atomization tower 102, and the collection chamber 106 as well, can be cooled by a fluid cooling source (not shown). In addition, the atomization tower 102 can be configured to allow the particles to free-fall while they cool. The metal particles 102 can then be segregated into groups of similar particle size using gravity, screening, or cyclonic separation. In an illustrative embodiment, the atomization tower 102 can have a vertical configuration such that a cone of particles 102 travels downward, and can be separated based on particle size by using inert gas jets to oppose the direction of the flying particles 102 at a 45 degree angle. A central funnel (not shown) can be used to catch the heavier particles 102, while one or more additional funnels (not shown) catch the lighter particles 102. The lighter particles 102 can be slowed down by the inert gas and redirected towards the additional funnels (not shown). The inert gas volumetric flowrate and velocity can be low enough such that they do not significantly affect the flight-path of the heaviest particles 102, yet they are still high enough to redirect the lighter smaller particles 102. The inert gas jet flowrate can be adjustable and the corresponding nozzles or the chamber-side inlet have various shapes and are interchangeable to allow for high control over particle size without an additional separation step. In another embodiment (not shown), the configuration of the atomization tower can be horizontal, such that the particles 102 follow an arced path over two or more collection funnels. The turbulence generated by the heat source 18 and the inert gas jets causes the powder produced to leave the die as a cone with a radial angle of about 45 degrees. The collection funnels within the atomization tower 104 can be arranged linearly in series below the cone of flying particles 102. Tubular passages within the atomization tower 104 emit a cone of inert gas behind the collection funnels. The inert gas inlet is directed towards the oncoming particles 102, causing the smaller particles to travel more slowly than larger particles 102. This enables the horizontal atomization tower 104 to produce powders that are separated based on particle size. Advantages to this embodiment over current technology include the following: increased powder cooling rate granted by the inert gas jet, increased powder cooling time due to the arced flight path of the powder, and increased utilization of workspace by increasing cooling rate and time without increasing chamber size.

The particle size, size distribution, shape, microstructure, and other properties of the particles 102 and powdered metal can be modified by using different atomization dies 88 and conditions. The variables that can be changed include the following: the velocity of the gas jet fluid, the pressure of the gas jet fluid, the velocity of the molten metal, the type of fluid used, the temperature of the fluid used, the temperature of the molten stream (superheat), the turbulence of the fluid, the pressure of the collection chamber, the turbulence of the collection chamber, fluid-jet shock wave frequency, current supplied to the induction coil (induced magnetic field which modifies molten stream), and more.

Figure 4C:
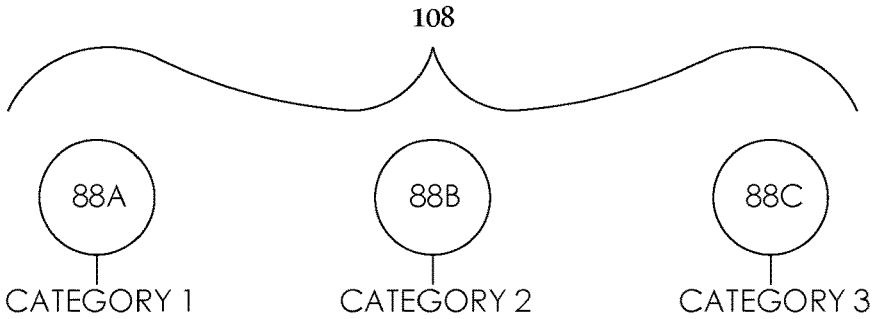
FIG. 4C is a schematic view of an assembly of interchangeable atomization dies, with each atomization die of the assembly configured for atomizing a specific category of raw materials.

As shown in FIG. 4C, the atomization die 88 can comprise a removal element of an assembly 108 of interchangeable atomization dies 88A, 88B and 88C, with each atomization die of the assembly configured for atomizing a specific category of raw materials category 1, category 2 and category 3. Some examples of fixed variables that can be modified by interchanging atomization dies 88 include: the materials used to construct the atomization die 88, the shape of the orifice 98 in which the molten metal passes through, the angle between the inert gas nozzles 96 and the molten stream, 100 the distance between the inert gas nozzles 96, the shapes of the tunnels in which the jet gasses pass through, the size of the collection chamber 106, and the shape of the inert gas nozzles 96. By using interchangeable removable atomization dies 88, many application-specific benefits can be realized within a single system. In addition, the particles 106 and resultant metal powders produced by the atomization system 22 have improved properties when compared to powders produced using traditional methods. Such properties include decreased presence of HDIs and LDIs, homogeneous fine-grained microstructures, improved toughness, increased ability to produce complex alloy parts, and greater ease of producing alloys without segregation or coarse dendrites. The atomization system 22, when compared to prior art systems is more thermally efficient, and generates a product with a higher purity.

Figure 5B:
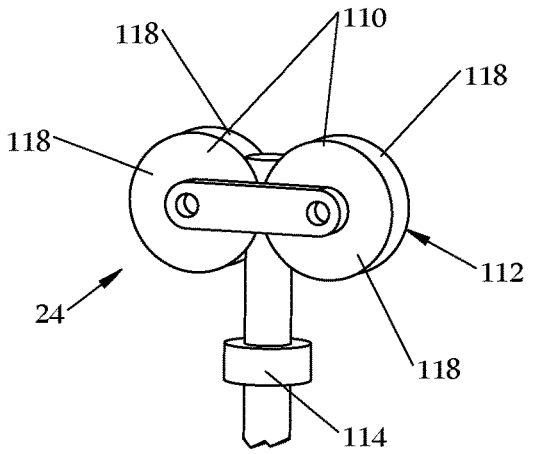
FIG. 5B is a perspective view of the roll caster system of the metallurgical system.
Figure 5A:
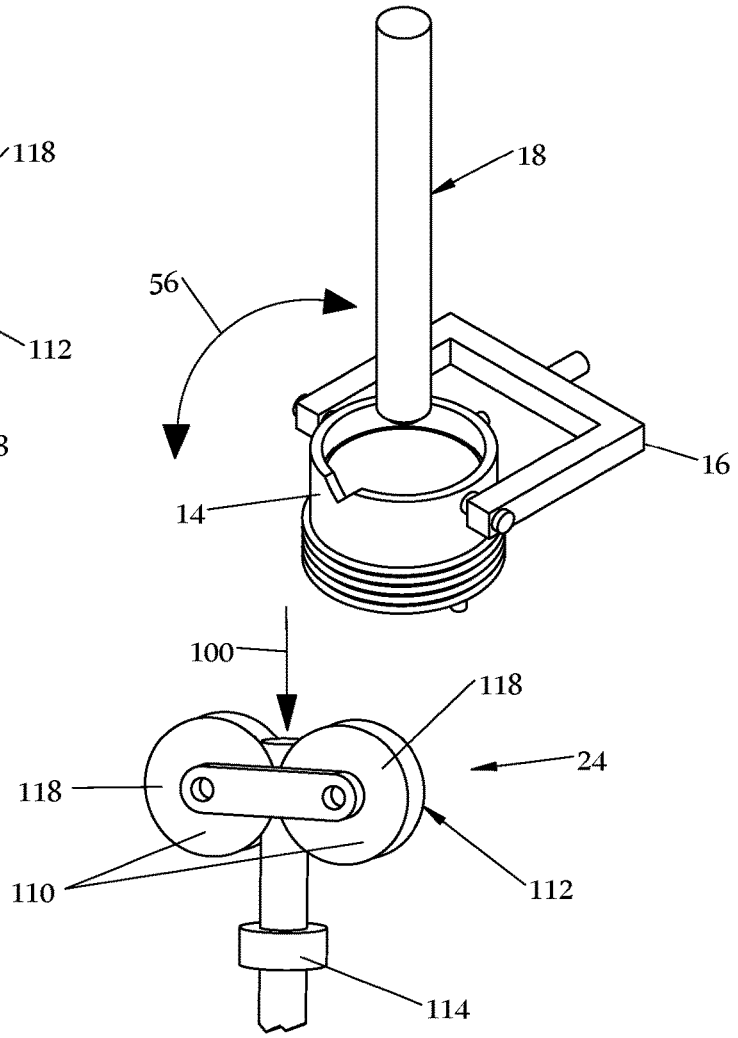
FIG. 5A is a perspective view of the mixing cold hearth and a roll caster system of the metallurgical system.
Figure 5C:
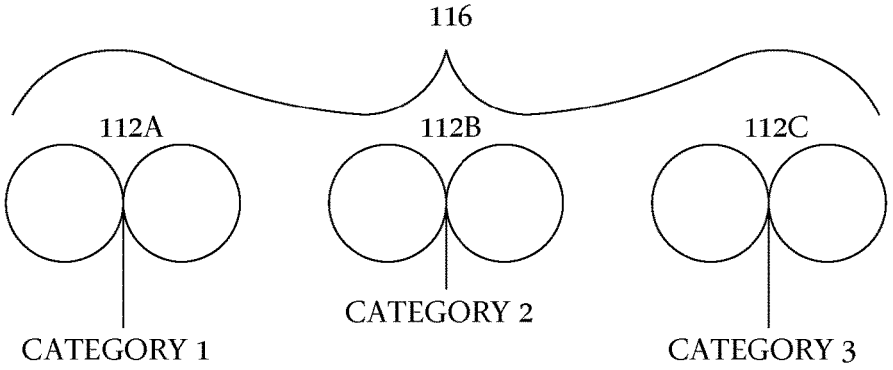
FIG. 5C is a schematic view of an assembly of interchangeable roll caster assemblies, with each roll caster assembly of the assembly configured for cooling a specific category of raw materials.

Referring to FIGS. 5A and 5B, the roll caster system 24 is shown. The roll caster system 24 includes a fluid cooled mold 110 configured to receive the molten metal stream 100 from the mixing cold hearth 14, a fluid cooled roll caster assembly 112 having rotatable rolls 118 configured to cool the molten metal stream 110 into a solidified shape, and a moveable dovetail 114 configured to adjust a size of the solidified shape. In addition, as shown in FIG. 5C, the roll caster assembly 112 can comprise a removal element of an assembly 116 of interchangeable roll caster assemblies 112A, 112B and 112C, with each roll caster assembly 112 of the assembly 116 configured for cooling a specific category of raw materials category 1, category 2, and category 3.

The fluid cooled mold 110 comprises an electrically conductive material having cooling passages in flow communication with a fluid cooling system 126 (FIG. 1) having a flow control valve 128. Alternately, the same fluid cooling system 72 (FIG. 1) used by the mixing cold hearth 14 can be used by the mold 110. The dovetail 114 is also fluid-cooled by the fluid cooling system 126 (FIG. 1), and is located in the center of the roll caster assembly 112. The dovetail 114 can also include a withdrawing ram (not shown) configured to eject partially-solidified metal from the dovetail 114. The molten metal stream 100 enters the fluid-cooled mold 110 and immediately solidifies on the walls thereof. This solidified metal is considered the skin. More molten metal is then able to flow through the skin onto the dovetail 114. The dovetail 114 contains the molten metal as it accumulates above the rolls 118 of the roll caster assembly 112. Once molten metal fills the mold 110, a level control sensor (not shown) is activated, and the rolls 118 and withdrawal ram move simultaneously. The metal that is in contact with the rolls 118 is cooled and solidified immediately. This cooling and solidification causes a reduction in the volume of the metal in most cases. As the metal shrinks, it is drawn through the rolls 118 and shaped in accordance with the two dimensional arrangement of the rolls 118. As metal is steadily solidified and ejected, additional molten metal is steadily added to the mold 110. This procedure is continued until the desired ingot length is achieved.

The dovetail 114 and the mold 110 are both removable and interchangeable, such that a variety of shapes of cast metal can be produced. The rolls 118 are fluid-cooled, and can be made from copper, molybdenum, titanium, tantalum, zirconium, nickel, silver, iron, and their alloys. In the preferred embodiment, the rolls 118 are made from copper. The rolls 118 are wheel-shaped and the wall that touches the molten metal is shaped in such a way as to form the product with a desired geometry. The roll caster assembly 112 can include from two to twenty rolls 118 arranged in a closed pattern, such that each roll 118 touches the other on the edges. The closed pattern can be defined as being comprised of a closed loop, but not necessarily being circular in arrangement. The rolls 118 are removable, adjustable, and interchangeable.

The geometry of the shaped solidified metal can be modified by interchanging the type of roll 118. The rolls 118 can have different geometries on the radial walls such that the final two-dimensional geometries of the solidified metal shapes can include i-beam, rectangle, square, circle, and trapezoid. In one embodiment, a roll configuration consists of rolls 118 with concave radial walls, and there are four rolls arranged such that each one is linearly opposed to another, and that each roll has 90 degree internal angles between it and each neighboring roll 118. The edges of these rolls 118 contact each other to form a complete circle. With this geometrical configuration, the roll caster assembly 112 will produce a cylindrical ingot. In another embodiment, a hexagon shaped ingot can be produced by arranging six rolls 118 in a hexagonal configuration such that each roll 118 has a flat radial wall and the edges connect with 120 degree internal angles. The radial walls of the rolls 118 can have shapes configured to produce different shaped products. By way of example, the shapes of the rolls can include: flat, flat with multiple radial steps, concave, concave with multiple radial steps, convex, convex with multiple radial steps, v-shaped protruding outward radially, v-shaped protruding inward radially, and multiple steps of a variety or mixture of shapes. Any conceivable shape of roll will be used to produce any conceivable shape of solidified metal. In addition, many configurations of rolls 118 can be interchanged to produce a variety of shaped cast metal objects.

The roll caster system 24 represents an improvement upon existing roll casting technology, particularly for reactive metals such as titanium. In this regard, roll casting technology has been used extensively for non-reactive metals such as steel, but has not heretofore been adapted to reactive metals, such as titanium. In addition, the roll caster system 24 permits generation of a variety of casting shapes within a single embodiment that is reconfigurable with a variety of interchangeable parts. By utilizing optimal roll configurations that are unique to each metal or alloy, a greater variety of castings can be produced without defects compared to traditional or established systems. The roll caster system 24 expands upon the number of metals which can be roll cast without generating defects such as lapping, run outs, or voids. Further, The roll caster system 24 is capable of efficiently producing ingots that are as small as ½ inch in diameter. This reduces amount of equipment and processing required to roll the ingots to smaller sizes. The roll caster system 24 thus reduces processing costs by enabling a casting of smaller ingots than established casting systems.

While a number of exemplary aspects and embodiments have been discussed above, those of skill in the art will recognize certain modifications, permutations, additions and subcombinations thereof. It is therefore intended that the following appended claims and claims hereafter introduced are interpreted to include all such modifications, permutations, additions and sub-combinations as are within their true spirit and scope.

What is claimed is:

1. A process for producing metals and metal alloys comprising:

providing a mixing cold hearth having a melting cavity configured to hold a raw material for melting into a molten metal, an induction coil configured to generate an electromagnetic field for stirring and heating the raw material in the melting cavity into the molten metal, and a mechanical drive configured to move the mixing cold hearth for mixing the raw material in the melting cavity;

feeding the raw material into the melting cavity;

heating the raw material in the melting cavity;

stirring the raw material during the heating step using the electromagnetic field;

moving the mixing cold hearth during the heating step using the mechanical drive;

providing an electrically conductive atomization die having an orifice for receiving the molten metal from the mixing cold hearth, and an induction coil configured to generate a magnetic field for interacting with the molten metal to generate a metal powder having a desired shape and particle size, and an atomization tower configured to receive and cool the metal powder;

transferring the molten metal from the mixing cold hearth to the atomization die; and atomizing the molten metal using the atomization die while generating the magnetic field.

2. The process of claim 1 wherein the moving step includes both oscillatory movement and rotational movement of the mixing cold hearth.

3. The process of claim 1 further comprising providing a heat removal system having a plurality of fluid cooled tiles configured to provide adjustable insulation for the molten metal; and controlling a temperature within the melting cavity using the heat removal system.

4. The process of claim 1 wherein the atomization die comprises a removable element of an assembly of interchangeable atomization dies.

5. A process for producing metals and metal alloys comprising:

providing a mixing cold hearth having a melting cavity configured to hold a raw material for melting into a molten metal, an induction coil configured to generate an electromagnetic field for stirring and heating the raw material in the melting cavity into the molten metal, and a mechanical drive configured to move the mixing cold hearth for mixing the raw material in the melting cavity;

feeding the raw material into the melting cavity;

heating the raw material in the melting cavity;

stirring the raw material during the heating step using the electromagnetic field;

providing a fluid cooled mold configured to receive the molten metal from the mixing cold hearth, a fluid cooled roll caster assembly configured to cool the molten metal into a solidified shape, and a moveable dovetail configured to adjust a size of the solidified shape;

transferring the molten metal from the mixing cold hearth to the mold;

cooling the molten metal in the mold using the roll caster assembly; and adjusting the size of the solidified shape using the dovetail.

6. The process of claim 5 wherein the roll caster assembly comprises a removable element of an assembly of interchangeable roll caster assemblies.

7. The process of claim 5 wherein the mixing cold hearth comprises a removable element of an assembly of interchangeable mixing cold hearths.

8. The process of claim 5 further comprising providing a skull in the melting cavity containing selected alloys, and rotating the mixing cold hearth during the heating step to at least partially melt the skull and incorporate the selected alloys into the molten metal.

9. A process for producing metals and metal alloys comprising:

providing a plurality of fluid cooled mixing cold hearths as an assembly of interchangeable mixing cold hearths, with each mixing cold hearth of the assembly having a melting cavity configured to hold a raw material for melting into a molten metal, and a mechanical drive configured to move the mixing cold hearth for mixing the raw material in the melting cavity;

selecting a particular mixing cold hearth;

feeding the raw material into the melting cavity of the particular mixing cold hearth;

heating the raw material in the melting cavity of the particular mixing cold hearth using a heat source; and oscillating and rotating the particular mixing cold hearth during the heating step using the mechanical drive.

10. The process of claim 9 further comprising providing a skull in the melting cavity containing selected alloys, and at least partially melting the skull during the heating step to incorporate the selected alloys into the molten metal.

11. The process of claim 9 further comprising providing a plurality of interchangeable atomization dies configured to atomize the molten metal as removable elements of an assembly, and selecting a particular atomization die of the assembly; and atomizing the molten metal using the particular atomization die.

12. The process of claim 9 further comprising providing a plurality of interchangeable roll caster assemblies configured to cool and shape the molten metal as removable elements of an assembly, with each roll caster assembly of the assembly configured for cooling and shaping a specific category of raw materials into a solidified shape; selecting a particular roll caster assemblies of the assembly; and cooling and shaping the molten metal using the particular roll caster assembly.

* * * * *